US006474998B1

(12) United States Patent
Takeuchi

(10) Patent No.: US 6,474,998 B1
(45) Date of Patent: Nov. 5, 2002

(54) CONNECTOR

(75) Inventor: Shinobu Takeuchi, Adachi-gun (JP)

(73) Assignee: Moldec Co., Ltd., Fukishima (JP)

( * ) Notice: Subject to any disclaimer, the term of this patent is extended or adjusted under 35 U.S.C. 154(b) by 0 days.

(21) Appl. No.: 09/916,672

(22) Filed: Jul. 30, 2001

(30) Foreign Application Priority Data

Jun. 28, 2001 (JP) ..... 2001-004245

(51) Int. Cl.[7] ..... H01R 12/00

(52) U.S. Cl. ..... 439/76.1; 439/607; 439/736; 439/946

(58) Field of Search ..... 439/76.1, 79, 607, 439/736, 945–947

(56) References Cited

U.S. PATENT DOCUMENTS 4,820,200 A * 4/1989 Lau ..... 439/607
5,104,329 A * 4/1992 Brown et al. ..... 439/108
6,165,028 A * 12/2000 Hirai et al. ..... 439/857

* cited by examiner

*Primary Examiner*—Khiem Nguyen
(74) *Attorney, Agent, or Firm*—Paul A. Guss

(57) ABSTRACT

Rising of a forwardmost edge of a shield for a connector is prevented without requiring double-sided tape or the like. The connector includes an insulating material casing, terminals attached to the casing, and a metal plate shield on an upper surface of the casing. A terminal portion houses the terminals, with boss portions projecting widthwise of the terminal portion. A flange portion and receiving groove are provided on the forward edge of the casing. First and second concavities exists on upper surfaces of the terminal portion and the boss portion, respectively. First tab portions are pressed into the first concavities, and second tab portions are pressed into the second concavities, making the shield inseparable from the casing. A bent portion at a forwardmost edge of the shield portion is received within the receiving groove for preventing an edge of the shield portion from rising up from the terminal portion.

3 Claims, 4 Drawing Sheets

CONNECTOR

BACKGROUND OF THE INVENTION

1. Field of the Invention

The present invention concerns a connector for use with a so-called PC card used primarily in notebook type computers.

2. Description of the Related Art

Conventional connectors which are used in so-called PC cards possess a roughly rectangular shaped casing, terminals which are connected in plural to the casing, and a shield which is attached to an upper surface of the casing. In the conventional connector, the casing possesses a terminal portion connected to the terminals assembled on a circuit board and a boss portion projecting in a widthwise direction from the terminal portion. Further, the shield possesses a shield portion which is attached to an upper surface of the terminal portion of the casing, an expanded-width portion disposed in a rearward position of the shield and which expands in a widthwise direction toward the aforementioned boss portion, and a lead portion which extends in a rearward direction from the expanded-width portion and which is connected to the circuit board.

In this type of connector for use with a PC card, according to prescribed standards, the width of the shield portion is narrower than the width of the terminal portion of the casing. In such a conventional connector, so that the forwardmost edge of the shield portion does not rise up from the forwardmost edge of the terminal portion, the upper surface of the terminal portion of the casing and the lower surface of the shield portion are attached to each other by a double-sided adhesive tape.

However, when the shield portion is attached to the terminal portion using a double-sided adhesive tape in this manner, there are inconveniences, in that it is difficult to accurately perform the positioning of both portions, and further, because of the necessity for removing grease or the like from surfaces to be adhered of both portions, the assembly operation becomes complicated.

In the connector which is used in this manner with a PC card, it has been desired to affix the terminal portion of the casing and the shield portion without using a double-sided adhesive tape.

SUMMARY OF THE INVENTION

Problem which the Present Invention Seeks to Solve:

The present invention aims at improving a connector, and furthermore specifically has the object of providing a connector in which, in order to eliminate the aforementioned inconveniences, the terminal portion of the casing and the shield portion thereof can be fixed together without using double-sided adhesive tape or the like.

Means for Solving the Problem:

For achieving the aforementioned objects, according to a first embodiment of the present invention, the connector is characterized by a substantially rectangular casing formed by an insulating body, a plurality of terminals disposed in a widthwise direction of the casing, and a plate-shaped shield disposed on an upper surface of the casing, wherein the casing comprises a terminal portion in which the terminals are disposed and a boss portion projecting in a widthwise direction from the terminal portion, in which a first groove portion is disposed on the terminal portion oriented downward from an upper surface thereof and between the terminals, and a second groove portion is disposed on the boss portion oriented downward from a upper surface thereof, and further wherein the shield comprises a shield portion formed of a width narrower than the terminal portion of the casing and which covers an upper surface of the terminal portion, an expanded-width portion disposed on a rearward position of the shield portion and expanding widthwise toward the boss portion, and a lead portion extending from the expanded-width portion toward the rear of the casing, in which a first tab portion is provided for insertion by pressing into the first groove portion in a vicinity of a front edge portion of the shield portion, and a second tab portion is provided for insertion by pressing into the second groove portion at an edge portion in the widthwise direction of the expanded-width portion.

In accordance with the connector of the first embodiment of the present invention, because the shield is fixed in place onto the casing by inserting by pressure (i.e., press-inserting) the first tab portions and the second tab portions into the first groove portions and second groove portions that are provided on the casing, it can be reliably secured to the casing. Accordingly, the forward edge of the shield is prevented from rising up from the casing without the use of a double-sided adhesive tape or the like. Further, because the first and second groove portions are disposed to be oriented downwardly of the casing, it is acceptable if only portions corresponding to the first and second groove portions are provided to be downwardly oriented in a conventional metal mold. As a result thereof, since a structure of an insert die or the like that is movable forward and backward is not needed in the mold for forming the casing, the structure of the concerned metal mold can be simplified.

Further, in the mold for forming the aforementioned casing, a structure such as an insert die or the like is unnecessary, and thus because a difference in grade is not generated between the mold for the upper surface of the casing and such an insert die, on the upper surface of the terminal portion of the casing the degree of flatness of the terminal portion can be improved. Accordingly, when attaching the shield to the casing, since the degree of flatness of the terminal portion is high, the horizontal degree of the lead portion is also preserved, so that when the lead portion is actually attached to the circuit board, soldering thereof can be reliably performed. Further, since the first groove portion is arranged at the terminal portion of the casing in between the terminals themselves, large scale changes are not added upon the conventional casing mold, and the metal mold therefore can be easily formed.

Next according to a second embodiment of the present invention, the connector is characterized by a substantially rectangular casing formed by an insulator, a plurality of terminals disposed in a widthwise direction of the casing, and a plate-shaped shield disposed on an upper surface of the casing, wherein the casing comprises a terminal portion in which the terminal portions are disposed, and wherein the shield comprises a shield portion formed of a width narrower than the terminal portion of the casing and which covers an upper surface of the terminal portion, an expanded-width portion disposed on a rearward position of the shield portion and expanding widthwise toward a widthwise edge portion of the terminal portion, and a lead portion extending from the expanded-width portion toward the rear of the casing, in which a through hole is provided penetrating through the front and rear in the vicinity of at least a front edge portion of the shield portion, and a protuberance is provided on the terminal portion, inserted in the through hole and projecting upwardly from a front surface of the shield portion, and in which, in a state in which the shield is attached to the casing, a portion of the protuberance projecting from the through hole is fastened by caulking.

According to the connector of the second embodiment of the present invention, the aforementioned through hole is disposed in the shield portion, and the protuberance which is inserted in the through hole in the terminal portion and attached by caulking is provided. Therefore, the shield is reliably affixed to the casing without using a double-sided adhesive tape or the like. Further, since the protuberance projects upwardly from the casing, mold-separation from the metal mold for forming the casing is easily performed in the vertical direction of the casing, and a structure of a core or the like which moves forward and rearward on the terminal portion of the casing need not be provided.

Further, in the connectors of the first and second embodiments, it is preferable for the shield to possess a bent portion that is curved downwardly at a forwardmost edge of the shield portion, wherein the casing is equipped with a receiving groove disposed in a downward direction along a lower surface of the bent portion in a vicinity of the front edge portion of the terminal portion. When such a bent portion is disposed on the shield, bending (warping) of the tip edge of the shield in the vertical direction is controlled by the bent portion. Further, because the bent portion is received along its bottom surface in the receiving groove which is inclined downward, the tip edge of the shield portion is prevented from rising upward.

DETAILED DESCRIPTION OF THE PREFERRED EMBODIMENTS

Next, exemplary embodiments of the present invention shall be explained with reference to FIG. 1 through FIG. 4.

Figure 1:
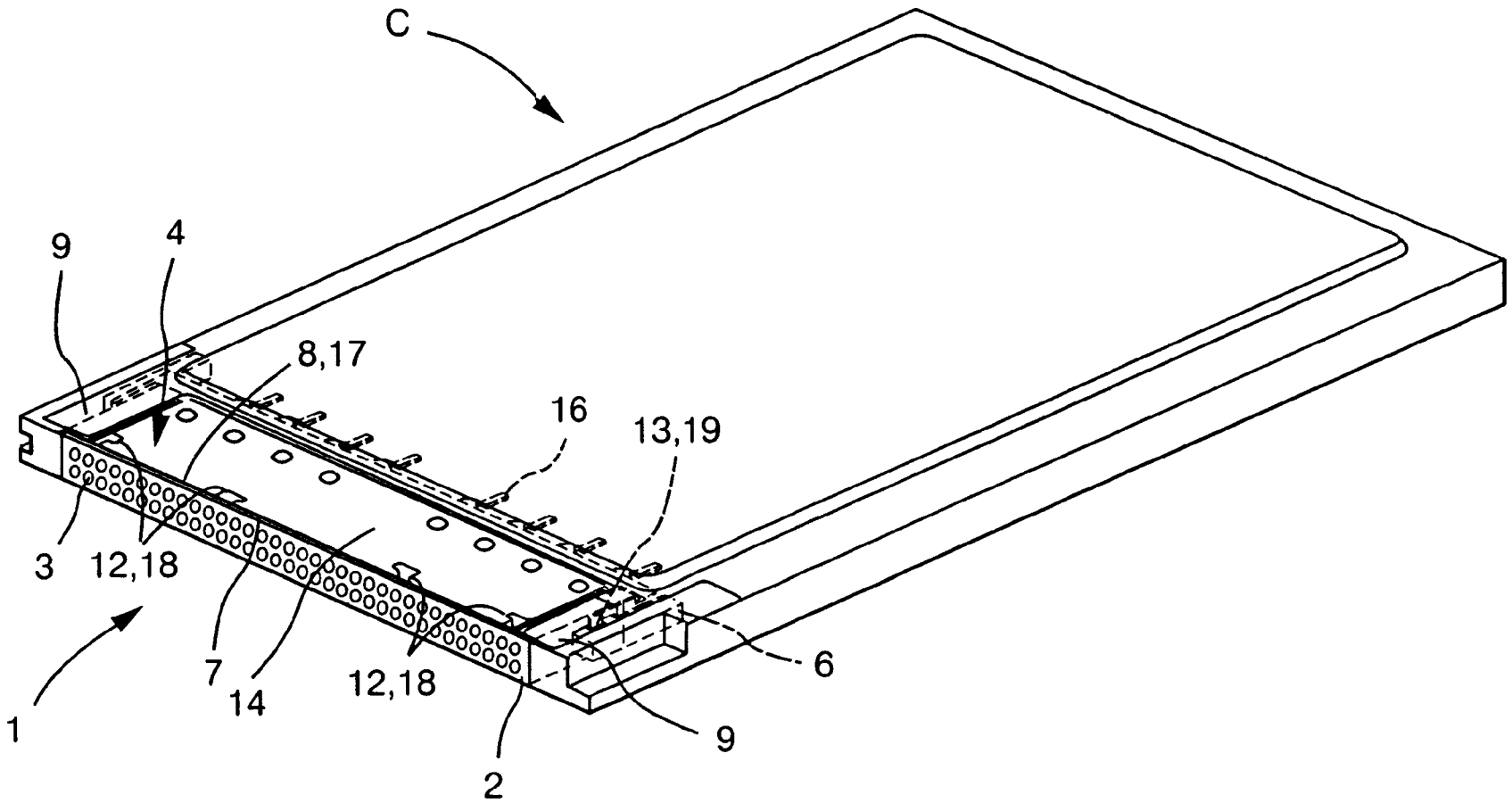
FIG. 1 is a view for explaining a state in which a connector according to a first embodiment of the present invention is used in a PC card.

A first embodiment of the connector 1 as shown in FIG. 1 is employed as a connecting portion of a PC card that is used by insertion into a slot of principally notebook type personal computers, comprising a substantially rectangular casing 2 formed from a composite resin having insulating properties, terminals 3 that are attached in plurality in a widthwise direction in two vertical rows of the casing 2, and a shield formed by a metallic plate attached to an upper surface of the casing.

Figure 2A:
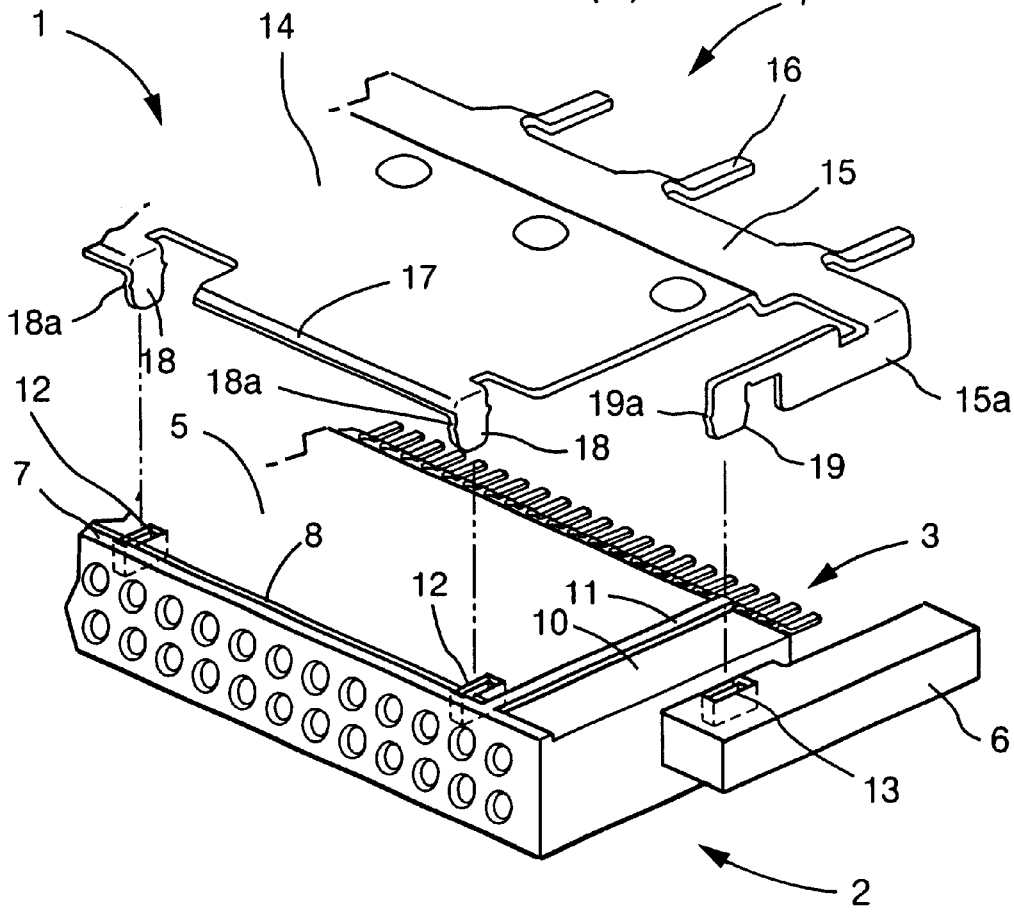
FIGS. 2(*a*) and 2(*b*) are views for explaining an attached state of the casing and shield of the connector according to the first embodiment.
Figure 2B:
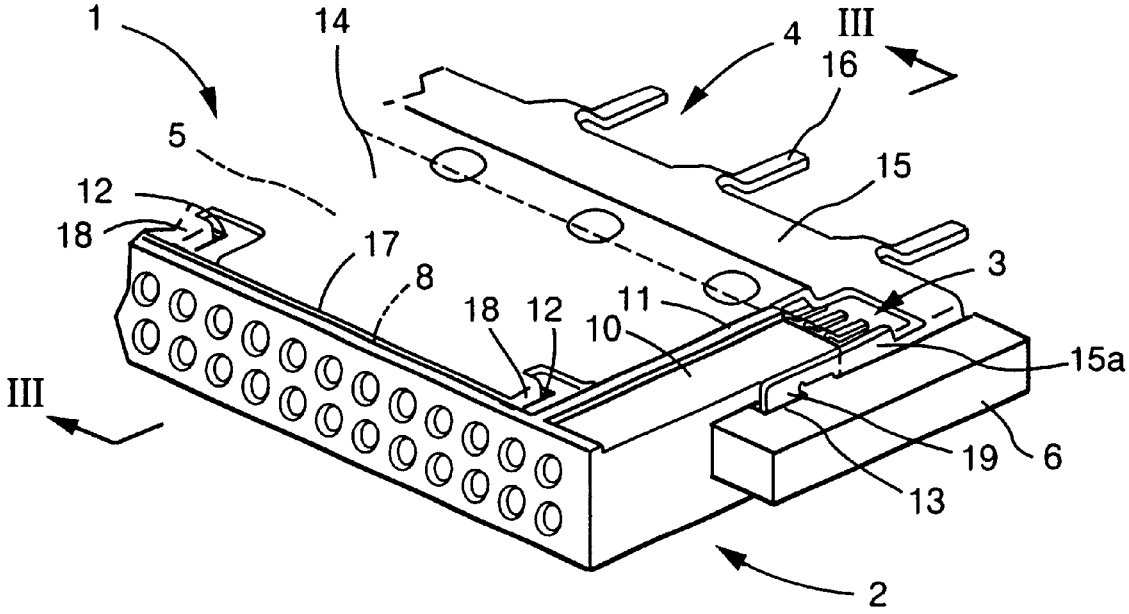
Figure 3:
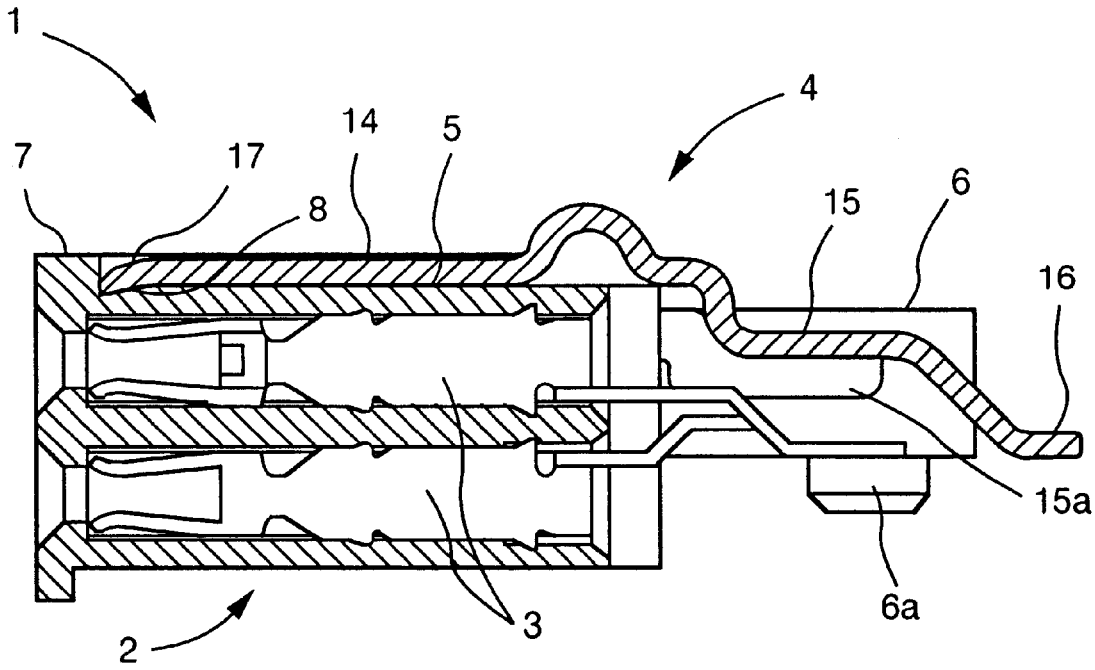
FIG. 3 is a cross-sectional view along line III—III in FIG. 2(*b*).

The casing 2, as shown in FIG. 2, comprises a terminal portion 5, to which the terminals 3 are attached, and a boss portion 6 projecting in a widthwise direction of the terminal portion 5. Further, as shown in FIG. 3, a flange portion 7 is provided which projects upwardly on a forwardmost edge of an upper surface of the casing, wherein a receiving groove 8 inclined downward so as to received therein a bent portion 17 of the shield 4 (to be discussed later) is disposed rearward of the flange portion 7. Still further, relief portions 10, which a PC-card C side shield 9 (shown in FIG. 1) comes into contact with, are provided on widthwise edges of the casing 2. Projections 11 are provided between the relief portions 10 and the surface to which the shield 4 is attached, for separating the PC card C side shield 9 and the shield 4 of the connector 1.

Further, as shown in FIG. 2, first groove portions 12, into which first tab portions 18 of the shield 4 (to be discussed later) are press-inserted, are disposed to be downwardly oriented on an upper surface of the terminal portion 5 of the casing 2, and second groove portions 13, into which second tab portions 2 (to be discussed later) are press-inserted, are disposed to be downwardly oriented on the boss portion 6. The first groove portions 12 are disposed between the terminals 3 themselves that are attached to the casing 2 and, as shown in FIG. 1, are provided at four locations. Moreover, as shown in FIG. 3, a projection 6*a* which projects downward from the boss portion 6 is fitted into an accommodating hole provided on a non-illustrated circuit board, for thereby positioning the connector 1.

As shown in FIG. 2, the shield 4 comprises a shield portion 14 for covering an upper surface of the terminal portion 5 of the casing 2, an expanded-width portion 15 projecting widthwise rearward of the shield portion 14 and extending widthwise to the boss portion 6 of the casing 2, and lead portions 16 projecting rearward of the expanded-width portion which are soldered to terminals of the circuit board (not shown). As shown in FIG. 3, a bent portion 17 which is bent downward is provided on a forwardmost edge of the shield portion 14. Further, on widthwise edge portions of the shield portion 14, first tab portions 18 which are press-inserted into the first groove portions 12 of the casing 2 are disposed extending downward at four locations. Still further, on widthwise edge portions of expanded-width portion 15, a pair of arms 15*a* are disposed extending in a frontward direction, wherein a pair of second tab portions 19, which are press-inserted into the second groove portions 13 of the casing, are disposed on tip portions of the arms 15*a* extending therefrom in a downward direction. When the first tab portions 18 and the second tab portions 19 are press-inserted into respective concavities of the casing 2, projections 18*a*, 19*a* are provided for preventing them from being pulled back out.

As shown in FIG. 2(*b*), in terms of the casing 2 and shield 4, the first tab portions 18 of the shield 4 are press-inserted into the first groove portions 12 of the casing 2, and the second tab portions of the shield 4 are press-inserted into the second groove portions 13 of the casing 2. At this time, because the projections 18*a*, 19*a* are provided respectively on each of the tab portions 18, 19, the shield 4 cannot become separated from the casing 2. Further, as shown in FIG. 3, because a bent portion 17 is provided on the forwardmost edge of the shield portion 14, it is difficult for the shield to bend or become warped in the vertical direction. Furthermore, because the aforementioned bent portion 17 is received in a receiving groove 8 that is provided on the terminal portion 5 of the casing 2 and which is inclined downwardly along a lower surface of the terminal portion 5, the forwardmost edge of the shield portion 14 does not rise up from the terminal portion 5 of the casing 2. Further, because the widthwise edges of the casing 2 are held by the pair of arms 15*a* that are provided on the widthwise edges of the expanded-width portion 15, the shield is prevented from slippage or misalignment in a widthwise direction.

In the first embodiment, the first groove portions 12 and second groove portions 13 provided on the casing are disposed so as to be oriented in a downward direction from the upper surface of the casing 2. Thus, in terms of a metal mold (not shown) used for forming the casing 2, leaving aside the through holes to which the terminals 3 are attached, it is acceptable for the casing 2 to be withdrawn or released from the mold in a vertical direction. Specifically, projections corresponding to the first groove portions 12 and second groove portions 13 are provided on the mold for forming the outer form of the casing 2, together with providing an inclined portion for the receiving groove 8, wherein after a resin has been injected into the metal mold, it is acceptable only for the mold for forming the outer aspect of the casing 2 to be pulled away and taken off in a vertical direction from the casing 2.

In this way, in respect to the connector 1 of the first embodiment, the metal mold for forming the casing 2 can have a simple structure, whereby in view of the fact that a structure for an insert die or the like movable in forward and rearward directions is not needed in the aforementioned mold, the degree of flatness of the upper surface of the terminal portion 5 of the casing 2 can be improved. For this reason, the lead portion 16 of the shield 4 can be kept horizontal by the terminal portion 5, and thus when the lead portions 16 are attached by soldering to the circuit board (not shown), the soldering thereof can be reliably performed.

Moreover, in the first embodiment, for the first and second: groove portions, respectively bottomed first groove portions 12 and second groove portions 13 are provided, however, they are not limited to such a structure, and it is also acceptable to provide them as through holes which penetrate vertically through the casing 2. Further, in the first embodiment, the first groove portions 12 and the first tab portions 18 are provided at four widthwise locations of the shield portion, however, they are not limited to this structure, and it is also acceptable if they are provided at two locations on widthwise edge portions of the shield portion 14.

Next, a connector 21 according to a second embodiment shall be described with reference to FIG. 4. In the second embodiment, the same reference numerals are applied for structures which are the same as in the above-described first embodiment, and detailed explanation thereof is omitted. In the connector 21 of the second embodiment, as shown in FIG. 4(*a*), convex portions or protuberances 22 are provided which project upwardly from the upper surface of the terminal portion 5 of the casing 2, wherein through holes 23 are provided in the shield portion 14 of the shield 4 through which the protuberances 22 are inserted.

Figure 4A:
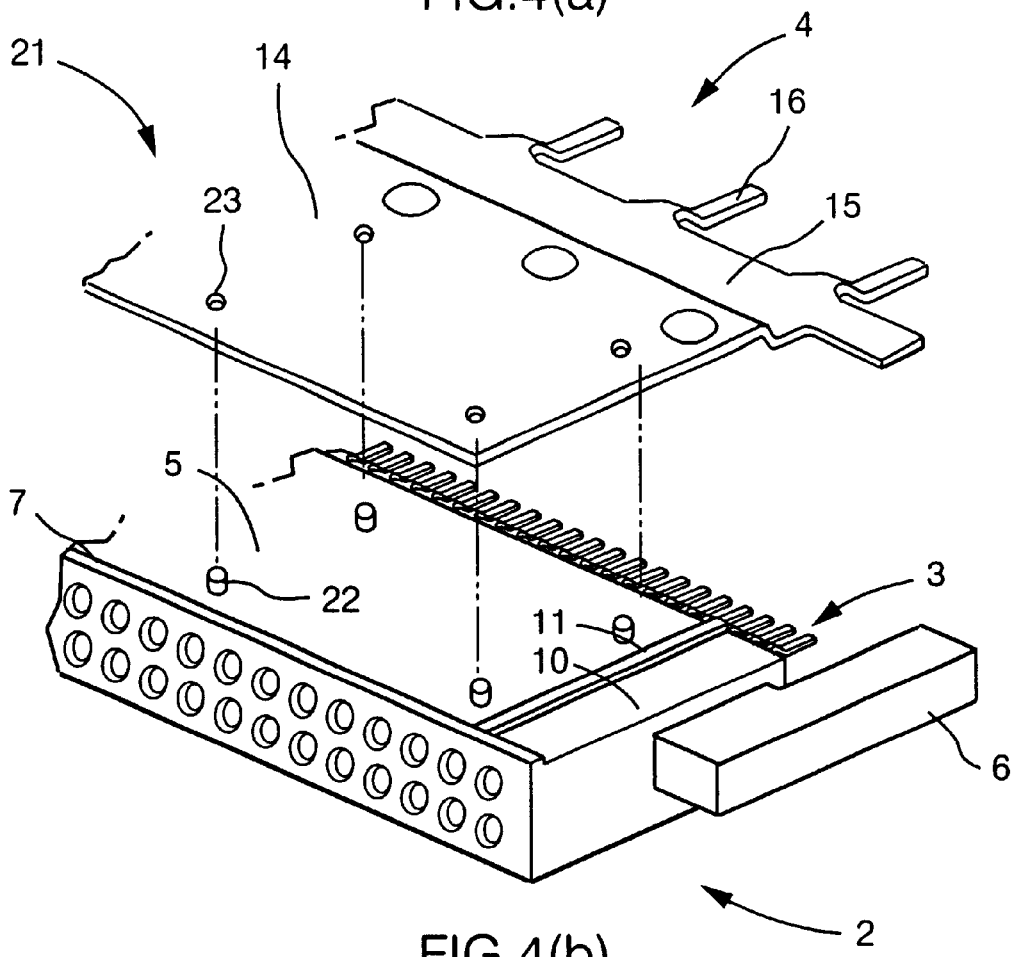
FIGS. 4(*a*) and 4(*b*) are views for explaining an attached state of the casing and shield of the connector according to a second embodiment.
Figure 4B:
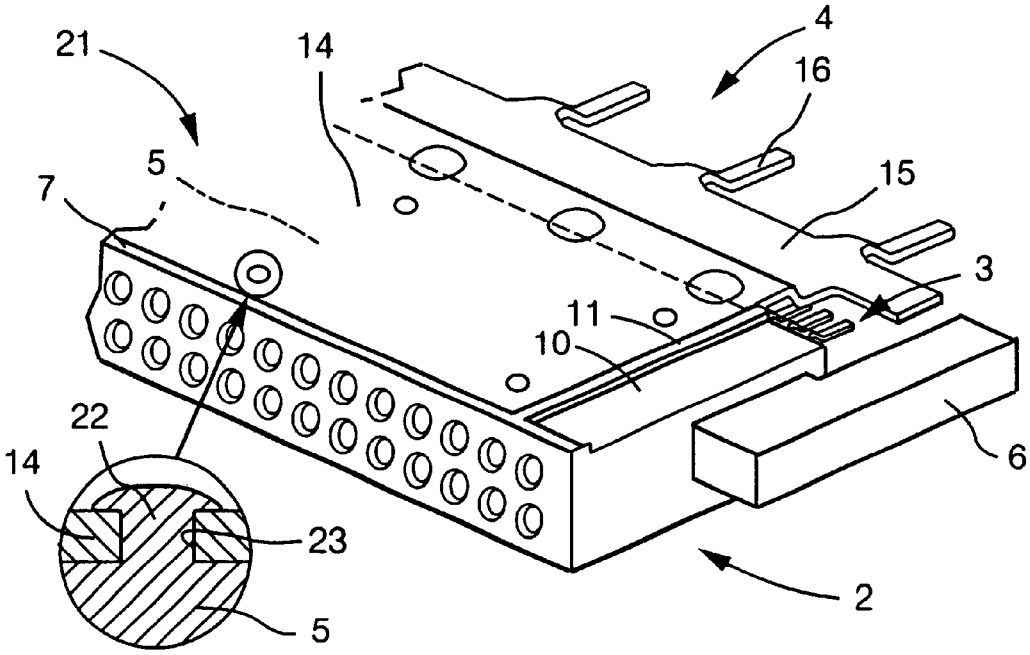

In the connector 21 of the second embodiment, as shown in FIG. 4(*b*), in a state in which the shield 4 is attached to the casing, as shown in the partially expanded cross-sectional view, the protuberances 22 are inserted into through holes 23 and are fixed in place by caulking using heat-caulking. In the present embodiment, the protuberances 22 and through holes 23 are not limited to being provided only in the vicinity of a front edge of the terminal portion 5, but may also be disposed in the vicinity of a rear edge thereof, wherein the shield 4 is fixed to the casing 2 at a total of eight locations. In this manner, in the second embodiment the shield 4 is strongly fixed and held in place on the casing by the protuberances 22 and through holes 23, and thus it is not necessary to provide arm portions 15*a* or second tab portions 19 on a widthwise edge portion of the expanded-width portion 15.

Moreover, similar to the first embodiment, in the second embodiment as well, a bent portion 17 may be provided. Further, in the above-described second embodiment, the protuberances 22 are deformed by heat-caulking for fixing the through holes 23 in place. However, the invention is not limited to this method, and it is also acceptable if the through holes 23 are fixed by caulking the protuberances 22 under ordinary temperature.

What is claimed is:

1. A connector comprising a substantially rectangular casing formed by an insulator, a plurality of terminals disposed in a widthwise direction of said casing, and a plate-shaped shield disposed on an upper surface of said casing, said casing comprising:

a terminal portion in which said terminals are disposed;

a boss portion projecting in a widthwise direction from said terminal portion; and a receiving groove comprising an inclined surface slanted in a downward direction and disposed in a vicinity of a front edge portion of said terminal portion, wherein a first groove portion is disposed on said terminal portion oriented downward from an upper surface thereof and between said terminals, and a second groove portion is disposed on said boss portion oriented downward from an upper surface thereof; and said shield comprising:

a shield portion formed of a width narrower than said terminal portion of said casing and which covers an upper surface of said terminal portion;

an expanded-width portion disposed on a rearward position of said shield portion and expanding widthwise toward said boss portion;

a lead portion extending from said expanded-width portion toward the rear of said casing; and a bent portion that is curved downwardly at a forward edge of said shield portion, wherein a lower surface of said bent portion is received along said inclined surface of said receiving groove, wherein a first tab portion is provided for insertion by pressing into said first groove portion in a vicinity of a front edge portion of said shield portion, and a second tab portion is provided for insertion by pressing into said second groove portion at an edge portion of the widthwise direction of said expanded-width portion.

2. A connector comprising a substantially rectangular casing formed by an insulator, a plurality of terminals disposed in a widthwise direction of said casing, and a plate-shaped shield disposed on an upper surface of said casing, said casing comprising:

a terminal portion in which said terminals are disposed; and a receiving groove comprising an inclined surface slanted in a downward direction and disposed in a vicinity of a front edge portion of said terminal portion; and said shield comprising:

a shield portion formed of a width narrower than said terminal portion of said casing and which covers an upper surface of said terminal portion;

an expanded-width portion disposed on a rearward position of said shield portion and expanding widthwise toward a widthwise edge portion of said terminal portion;

a lead portion extending from said expanded-width portion toward the rear of said casing; and a bent portion that is curved downwardly at a forward edge of said shield portion, wherein a lower surface of said bent portion is received along said inclined surface of said receiving groove, wherein a through hole is provided penetrating through the front and rear in the vicinity of at least a front edge portion of said shield portion, and a protuberance is provided on said terminal portion, inserted in said through hole and projecting upwardly from a front surface of said shield portion, and wherein when said shield is attached to said casing, a portion of said protuberance projecting from said through hole is fastened by caulking.

3. The connector according to claim 1 or 2, wherein said bent portion extends substantially from one end to another end of the forward edge of said shield portion.

* * * * *